US005906087A

United States Patent [19]

Boldrini

[11] Patent Number: 5,906,087

[45] **Date of Patent: *May 25, 1999**

[54] BLANK GUMMING METHOD FOR CIGARETTE PACKING MACHINES

[75] Inventor: Fulvio Boldrini, Buglione, Italy

[73] Assignee: G.D. Societa' Per Azioni, Bologna, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/600,898

[22] Filed: Feb. 13, 1996

[30] Foreign Application Priority Data

Feb. 14, 1995 [IT] Italy ..... B095A0052

[51] Int. Cl.[6] ..... B65B 11/00

[52] U.S. Cl. ..... 53/462; 53/466; 53/234

[58] Field of Search ..... 53/462, 207, 208, 53/466, 234, 148

[56] References Cited

U.S. PATENT DOCUMENTS

| | | | |
|---|---|---|---|
| 4,487,596 | 12/1984 | Livens et al. | 493/125 |
| 5,462,223 | 10/1995 | Focke et al. | 229/160.1 |

FOREIGN PATENT DOCUMENTS

| | | |
|---|---|---|
| 423367 | 1/1935 | United Kingdom . |
| 445884 | 4/1936 | United Kingdom . |
| 1 459 091 | 12/1976 | United Kingdom . |
| 2 091 162 | 7/1992 | United Kingdom . |

*Primary Examiner*—James F. Coan
*Assistant Examiner*—Gene L. Kim
*Attorney, Agent, or Firm*—Marshall, O'Toole, Gerstein, Murray & Borun

[57] ABSTRACT

A blank gumming method for cigarette packing machines, whereby a blank, presenting a central portion defining the front, rear and end walls of a respective packet, and two lateral portions located on either side of the central portion and defining, by superimposition, the lateral walls of the packet, is gummed in two successive steps, one preceding and the other following mating of the blank with a respective group of cigarettes; one of the two steps being performed by spraying adhesive material.

4 Claims, 3 Drawing Sheets

BLANK GUMMING METHOD FOR CIGARETTE PACKING MACHINES

BACKGROUND OF THE INVENTION

The present invention relates to a blank gumming method for cigarette packing machines.

More specifically, the present invention relates to a blank gumming method for cigarette packing machines wherein each blank is mated with a respective group of cigarettes, and is folded about the group to form a container, the blank presenting a central portion defining the front wall, the rear wall and two first end walls of the container, and two lateral portions on either side of the central portion and defining, by at least partial superimposition, two second end walls of the container.

Here and hereinafter, the term "cigarette packing machine" is intended to mean both a packing machine in the real sense of the word, i.e. a machine for receiving loose cigarettes and conditioning them into containers consisting of packets formed from respective flat blanks of cardboard or similar, and an overwrapping machine, i.e. a cartoning or boxing machine for receiving the cigarettes already conditioned inside packets or cartons, and for further conditioning them into containers formed from respective flat blanks of cardboard or similar.

For the sake of simplicity, the following description refers, purely by way of example, to actual cigarette packing machines.

GB A-2091162 and EP A-601411 relate to the formation of so-called rigid, hinged-lid packets from a blank made of cardboard or similar, and which, when withdrawn from a feedbox, is placed, still flat, onto a conveyor, and is fed to a spray gumming station where all the portions of the blank to be connected stably to other parts of it and to the group of cigarettes to be conditioned are gummed simultaneously.

The above method presents several drawbacks. In particular, since the blank is folded as it travels through a succession of folding stations distributed along a relatively long folding path, all the in-process packets located along the folding path and downstream from the gumming station must be rejected in the event of stoppage of the packing machine.

SUMMARY OF THE INVENTION

It is an object of the present invention to provide a gumming method designed to overcome the aforementioned drawback.

According to the present invention, there is provided a blank gumming method for cigarette packing machines wherein each blank is mated with a respective group of cigarettes, and is folded about the group to form a container, the blank presenting a central portion defining the front wall, the rear wall and two first end walls of the container, and two lateral portions on either side of the central portion and defining, by at least partial superimposition, two second end walls of the container; characterized in that it comprises two successive gumming steps, a first preceding and a second following mating of the blank with the respective group of cigarettes; at least one of the two steps being performed by spraying adhesive material.

Preferably, said first step in the above method provides for gumming said central portion, and said second step for gumming said lateral portions.

Moreover, said second step is preferably a spray gumming step.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
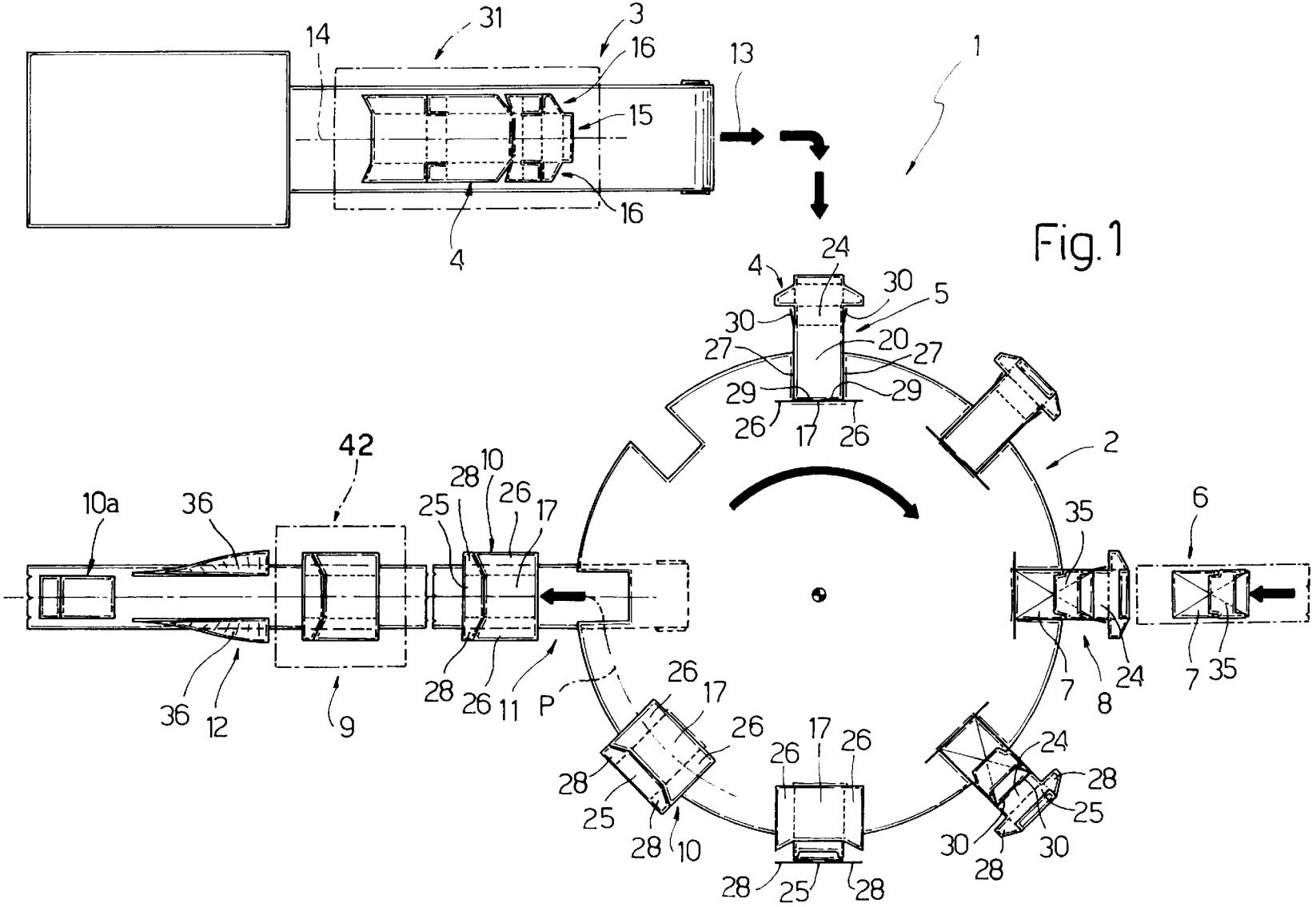
FIG. 1 shows a schematic plan view of a portion of a cigarette packing machine implementing the method according to the present invention.

Number 1 in FIG. 1 indicates a cigarette packing machine comprising a wrapping wheel 2; a first line 3 for feeding blanks 4 onto wheel 2 at an input station 5; a second line 6 for feeding prewrapped groups 7 of cigarettes onto wheel 2 at a loading station 8; and an unloading line 9 for receiving semifinished rigid, hinged-lid packets 10 from wheel 2 at an unloading station 11, and feeding them through a final folding station 12.

Figure 2:
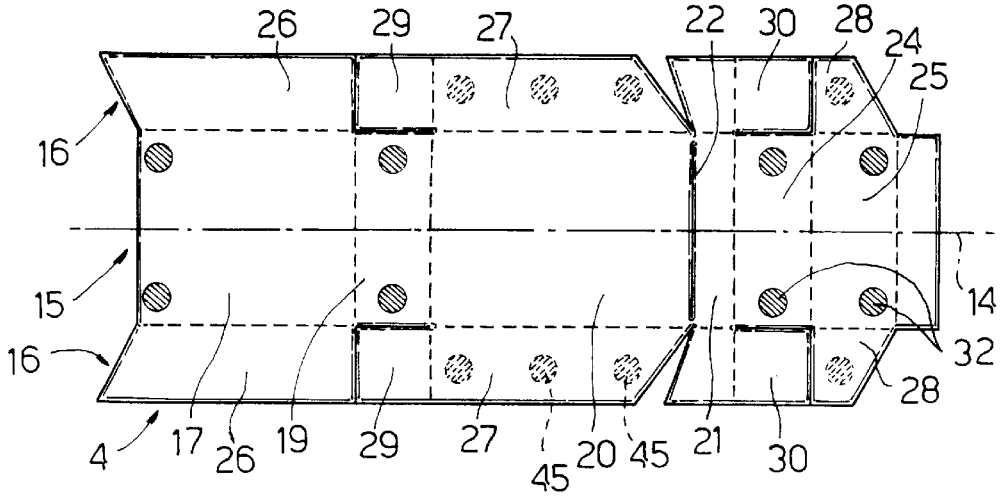
FIG. 2 shows a plan view of the blank employed on the FIG. 1 machine.
Figure 3:
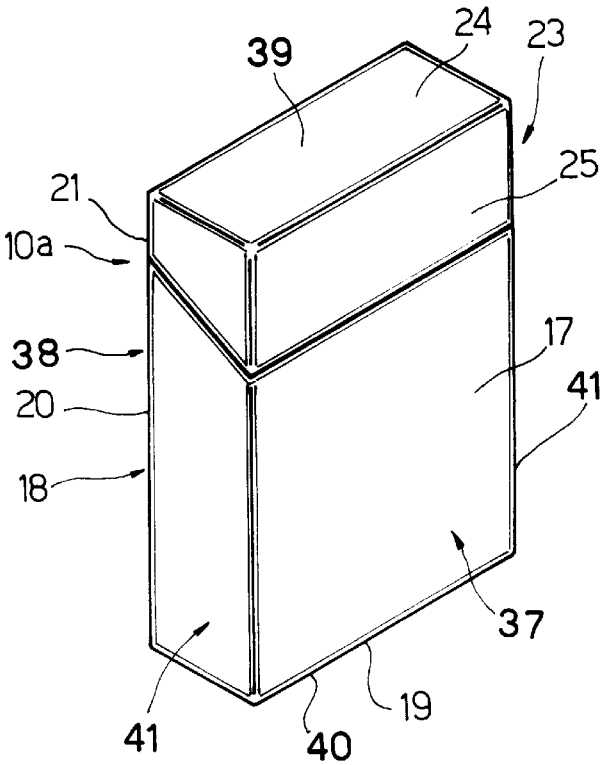
FIG. 3 shows a view in perspective of the packet formed on the FIG. 1 machine.

Each blank 4 is fed along line 3 in a direction 13 parallel to its longitudinal axis 14, and comprises (FIG. 2) a central portion 15, and two lateral portions 16 located specularly on either side of central portion 15 and parallel to axis 14. Central portion 15 comprises a first panel 17 defining the front wall of the lower body 18 of the finished packet 10*a* (FIG. 3); a second panel 19 defining the bottom wall of body 18; a third panel 20 defining the rear wall of body 18; a fourth panel 21 separated from panel 20 by a hinge line 22 and defining the rear wall of the lid 23 of body 18; a fifth panel 24 defining the top wall of lid 23; and a sixth panel 25 defining the front wall of lid 23.

Each lateral portion 16 comprises a tab 26 extending laterally from panel 17; a tab 27 extending laterally from panel 20; and a tab 28 extending laterally from panel 25. Each tab 27 presents, at opposite longitudinal ends, two longitudinal tabs 29 and 30, the first of which is located outwards of a respective lateral edge of panel 19, and the second of which is located outwards of a respective lateral edge of panel 24.

With reference to FIG. 1, line 3 feeds blanks 4 successively through a first gumming station 31 where given surface portions 32 (FIG. 2) of central portion 15 of each blank are coated with adhesive material.

Figure 4:
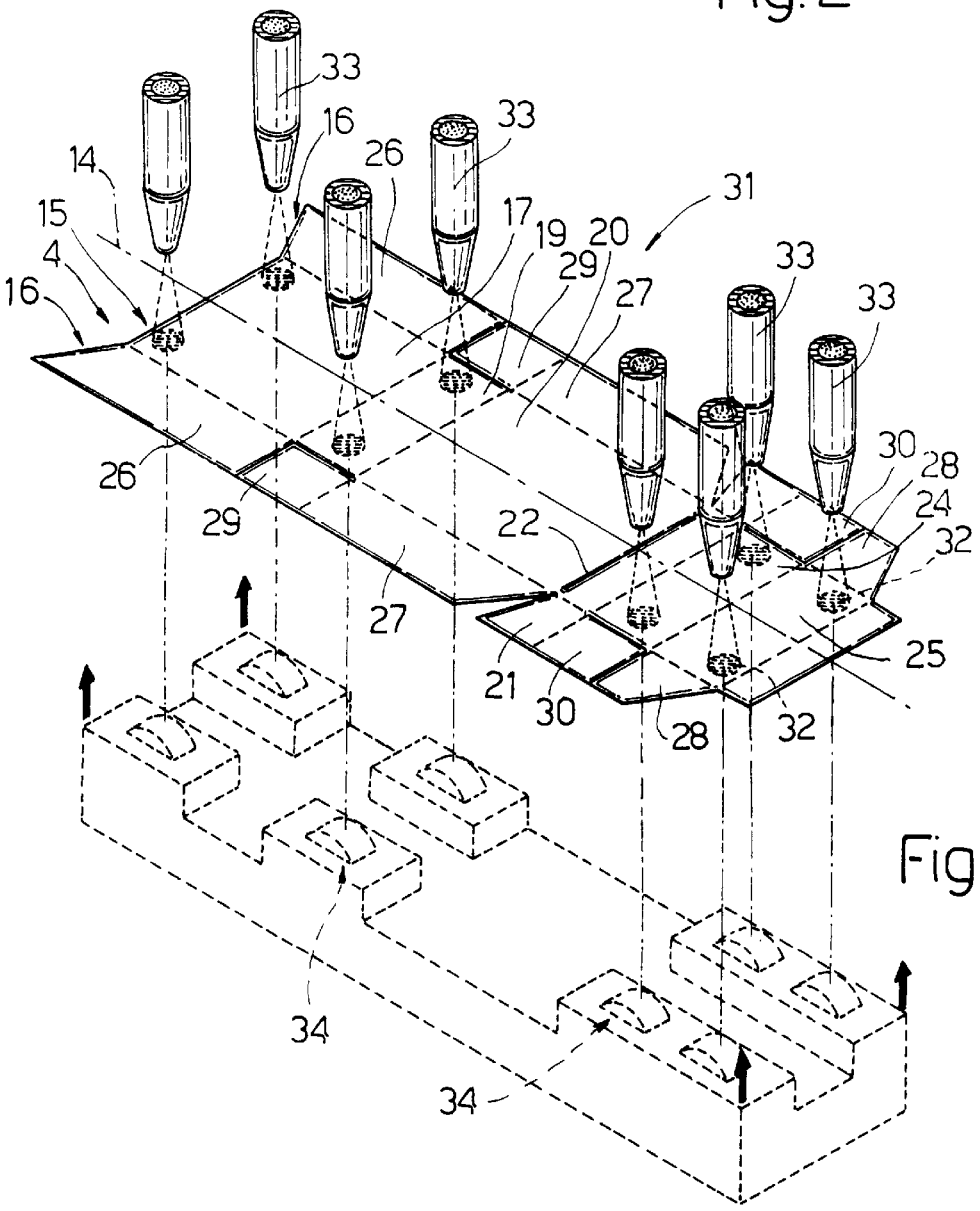
FIG. 4 shows a schematic view of a first station for gumming the FIG. 2 blank.

The blanks may be fed along line 3 with the surface of central portion 15 to be partially coated with adhesive material facing upwards or downwards. In the first case, as shown by the continuous line in FIG. 4, the adhesive material is supplied by known spray gumming devices 33 over line 3. In the second case, as shown by the dotted line in FIG. 4, the adhesive material is supplied by known gumming roller devices 34 located beneath the transportation surface of line 3.

As shown in FIG. 1, as it is transferred onto wheel 2 at input station 5, each blank 4 undergoes in known manner a first folding operation wherein tabs 27 are folded squarely in relation to panel 20, tabs 29 are folded squarely in relation to respective tabs 27, and coplanar panels 17 and 19 are folded squarely in relation to panel 20 to stick panel 19 onto tabs 29.

Each blank, folded as described above, is fed by wheel 2 to loading station 8 where a group 7, preferably provided with a collar 35, is fed onto panels 20 and 21, and between tabs 27 and 30 into contact with tabs 29 and panel 19.

At this point, and in known manner, tabs 30 are folded squarely in relation to respective tabs 27 and onto one end of respective group 7; panel 24 is then folded squarely in relation to panel 21 so as to stick onto tabs 30; and panel 25 is folded squarely in relation to panel 24 and over respective group 7, so that, together with tabs 28, it is coplanar with panel 17 and tabs 26, and forms a respective semifinished packet 10, which is transferred in known manner to unloading line 9 at station 11. Line 9 feeds packet 10 through final folding station 12 where each pair of tabs 26 and 28, still coplanar with each other and with panels 17 and 25, comes into contact with a respective fixed folding device 36 by which they are folded squarely in relation to panels 17 and 25 and onto respective tab 27 to form a finished packet 10*a*.

Packet 10*a* presents a front wall 37 defined by panels 25 and 17; a rear wall 38 defined by panels 20 and 21; two end walls 39 and 40 defined respectively by panels 24 and 19; and two lateral end walls 41, each defined by respective tabs 28 and 26 superimposed on respective tab 27.

Figure 5:
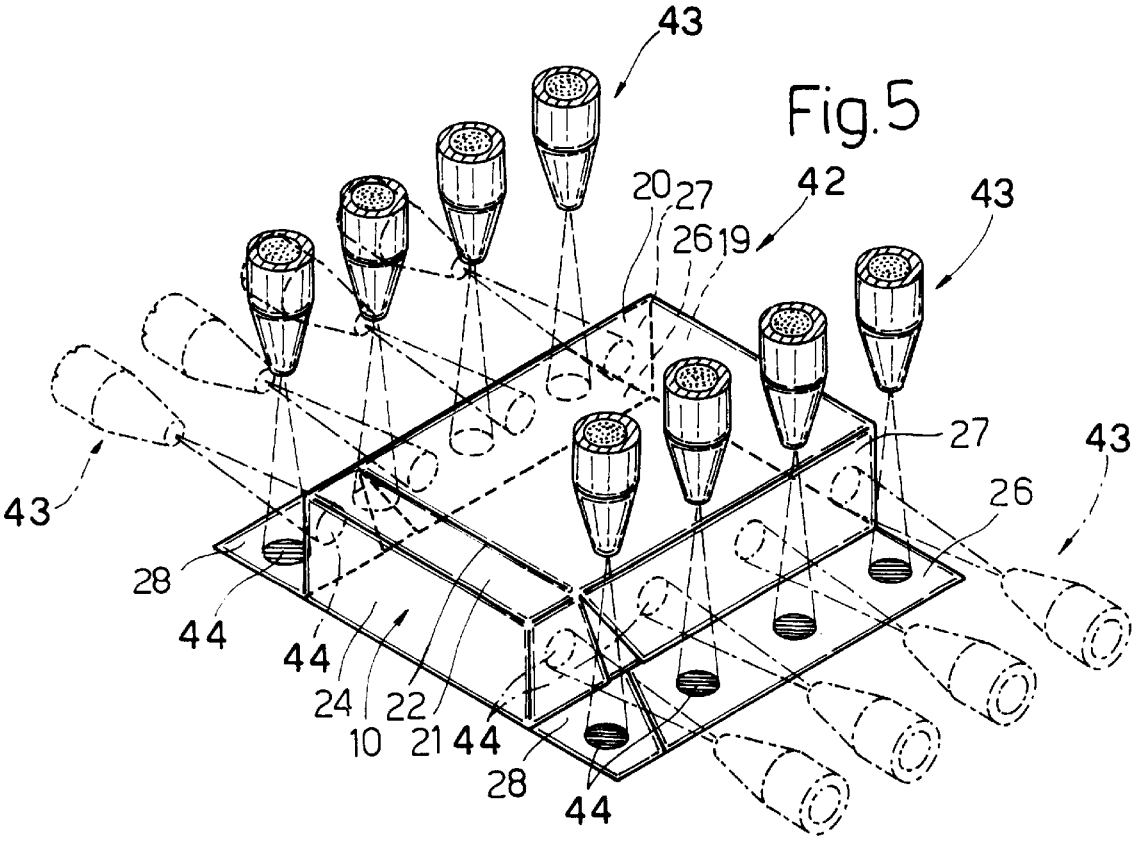
FIG. 5 shows a schematic view in perspective of a second station for gumming a cigarette packet blank.

At any point along the path P of semifinished packet 10 along part of wheel 2 and the part of unloading line 9 upstream from station 12, there is provided a second gumming station 42 (FIG. 1) comprising, on either side of semifinished packet 10 (FIG. 5), at least two known spray gumming devices 43 (in the example shown, four gumming devices 43 are provided on each side) positioned vertically (continuous line in FIG. 5) and directed towards respective tabs 26 and 28, or positioned horizontally (dotted line in FIG. 5) and directed towards respective tabs 27, to form adhesive-coated portions 44 by which to stick tabs 26 and 28 to tabs 27.

The advantages of coating blank 4 with adhesive material in two steps are obvious. If all the adhesive were to be applied in station 31, any stoppage of machine 1 would result in rejection of all the in-process packets between station 31 and folding devices 36.

I claim:

1. A method of producing a rigid finished cigarette container (10*a*) with a group (7) of cigarettes therein using a flat blank (4) of a substantially rigid carton; the blank (4) comprising a central longitudinal portion (15) defining a front wall (37), a rear wall (38) and two first end walls (39, 40) of the container (10*a*); and two lateral longitudinal portions (16) arranged on either side of the central longitudinal portion (15) and defining, by at least partial superimposition, two second end walls (41) of the container (10*a*); the method comprising:

(a) feeding said blank (4) still in flat condition to a first gumming station (31);

(b) applying adhesive in a first gumming operation to form adhesive surface portions (32) on said central longitudinal portions (15) of said blank (4) at said first gumming station (31);

(c) feeding said blank (4) to a folding device (2);

(d) mating said blank (4) with a group (7) of cigarettes inside said folding device (2);

(e) performing a first sequence of folding operations, by which the blank (4) is folded about said group (7) of cigarettes to form a semi-finished container (10) enclosing said group (7) with said two lateral longitudinal portions (16) remaining substantially coplanar following said sequence of folding operations, and without said semifinished container (10) having any exposed adhesive surface portions (32);

(f) feeding said semi-finished container (10) to a second gumming station (42);

(g) applying adhesive in a second gumming operation to said lateral longitudinal portions (16) of said semi-finished container (10) at said second gumming station (42);

(h) finishing said semi-finished container (10) in a last folding operation by which said two lateral longitudinal portions (16) containing adhesive are at least partially superimposed to define said two second end walls (41) and to obtain said finished container (10*a*) with a group (7) of cigarettes therein; and, (i) wherein at least one of the two gumming operations is a spray gumming operation.

2. A method as claimed in claim 1, wherein said second gumming operation is a spray gumming operation.

3. A method as claimed in claim 1, wherein said first gumming operation is carried out on said blank by moving said blank (4) longitudinally past a number of gumming means (33, 34) for gumming said central portion (15).

4. A method as claimed in claim 1, wherein said second gumming operation is carried out on said semi-finished container by moving said semi-finished container longitudinally past a number of spray gumming devices (43) for gumming said lateral portions (16).

* * * * *